US010006231B2

(12) United States Patent
Grommet

(10) Patent No.: US 10,006,231 B2
(45) Date of Patent: Jun. 26, 2018

(54) DOUBLE LEVER LATCH DEVICE

(71) Applicant: Dean G Grommet, Whitefish, MT (US)

(72) Inventor: Dean G Grommet, Whitefish, MT (US)

( * ) Notice: Subject to any disclaimer, the term of this patent is extended or adjusted under 35 U.S.C. 154(b) by 100 days.

(21) Appl. No.: 14/859,194

(22) Filed: Sep. 18, 2015

(65) Prior Publication Data

US 2017/0081887 A1 Mar. 23, 2017

(51) Int. Cl.
*E05B 3/00* (2006.01)
*E05C 3/08* (2006.01)
*E05B 17/20* (2006.01)

(52) U.S. Cl.
CPC ..... *E05C 3/08* (2013.01); *E05B 17/2034* (2013.01)

(58) Field of Classification Search
USPC ..... 292/230, 231, 236, 336.3, 347
See application file for complete search history.

(56) References Cited

U.S. PATENT DOCUMENTS 408,552 A * 8/1889 Thowne ..... E05B 85/22 292/164
495,624 A * 4/1893 Coffield ..... E05C 3/124 292/226
692,827 A 2/1902 Chesher
973,928 A * 10/1910 Edey ..... E05C 3/12 292/210
1,059,952 A * 4/1913 Spooner ..... E05B 85/16 292/226
1,193,531 A * 8/1916 Fogg ..... E05B 65/0811 292/134
1,314,268 A * 8/1919 Irwin ..... E05C 3/12 292/236
1,334,789 A * 3/1920 Parsons ..... E05C 3/12 292/236
1,588,289 A * 6/1926 Yenichek ..... E05C 3/14 292/231
1,592,514 A * 7/1926 Bowes ..... E05C 3/12 292/236
1,763,692 A * 6/1930 Ferris ..... E05C 3/167 292/236
1,868,471 A * 7/1932 Griffin ..... E05B 63/22 292/236
2,321,724 A * 6/1943 Aldeen ..... E05C 1/14 292/173
2,644,708 A * 7/1953 Poole ..... E05C 3/167 292/210
5,511,835 A * 4/1996 Hardee ..... E05B 17/2023 292/205

(Continued)

*Primary Examiner* — Carlos Lugo

(57) ABSTRACT

A dual handled latch device or spindle-free and cylinder-free lockset is provided for opening and closing a door from either side of the door. The latch device comprises an angled lever located on each side of the door, one end of each lever acting as a manipulatable handle and the other end lying under and perpendicular to a latch arm located on the surface of one side of the door. When the handle end of either lever is pulled, the lever pivots about a fulcrum point at the lever angle, lifting and releasing the latch arm so the door can be opened. In a preferred embodiment, the latch lifting ends of the two levers are mutually opposing with one latch lifting leg end is superposed on the other. The latch arm also can be locked in its latched, closed position.

7 Claims, 8 Drawing Sheets

(56) References Cited

U.S. PATENT DOCUMENTS

| | | | | |
|---|---|---|---|---|
| 5,700,044 | A * | 12/1997 | Wartian | E05C 3/162<br>292/165 |
| 7,753,418 | B2 * | 7/2010 | Fleming | E05B 7/00<br>292/32 |
| 8,678,451 | B2 | 3/2014 | Martin | |
| 9,605,891 | B2 * | 3/2017 | Lee | F25D 23/02 |

* cited by examiner

DOUBLE LEVER LATCH DEVICE

FIELD OF USE

Embodiments of the present disclosure find applicability in the field of door latching mechanisms.

BACKGROUND

Two-way door latching mechanisms are well known in the art. Typically doors are opened and closed today by means of a lockset which includes both a manipulatable handle or knob for moving the door and also for engaging a latching mechanism. A lockset generally includes an interior knob (or handle) and an exterior knob (or handle) which are connected by a spindle. Rotating either knob rotates the spindle, allowing it to catch and engage a latch mechanism. The latch mechanism includes a cylinder perpendicular to the spindle, and turning a knob pulls the cylinder in the direction of the turn. The free end of the cylinder is the latch, extending out from the door's edge and into an opening in the opposing door frame or door jamb. When the door is closed the latch is engaged with the opposing door frame and the door cannot be opened. Rotating the knob, spindle and cylinder retracts the latch from its position in the door frame opening, allowing the door to be opened. Where the knob is a handle, the handle itself may rotate, or it can include a levering means, typically a depressable lever, that rotates the attached spindle.

Another well-characterized two-way door latching mechanism involves a liftable latch arm and latch keep on the surface of the inside side of the door, and a means for lifting the latch arm on the surface of the outside side of the door. Traditionally the outside lifting means is an elongated bar, called a thumb lever, that passes through the door and on which the latch arm rests. When one end of the thumb lever bar is depressed on the outside of the door, the other end of the bar is lifted, lifting the latch arm with it, past the latch keep, and allowing the door to open.

SUMMARY

This summary is provided to introduce a selection of concepts in a simplified form that are further described below in the Detailed Description. This summary is not intended to identify key features of the claimed subject matter on its own, nor is it intended to be used on its own as an aid in determining the scope of the claimed subject matter.

The present disclosure relates, in one embodiment, to a two-way latch device for a door having an inside and an outside face. The latch device also can be considered a spindle-free and cylinder-free lockset. The device comprises a latch arm, an inside lever having an angled pivot or fulcrum point, an outside lever having an angled pivot or fulcrum point, means for attaching the inside lever to the inside door face, and means for attaching the outside lever to the outside door face, each lever being attached at its angled pivot point. The latch arm preferably is an elongated bar having a pivot end and a latch keep end, secured to the door at the latch arm's pivot end and positioned such that the longitudinal axis of the latch arm is substantially perpendicular to the vertical axis of the door. Each angled lever can have a handle end and a latch lifting end and be attached to its respective door face by an attachment means such that the longitudinal axis of the handle end is substantially parallel to the vertical axis of the door and the latch lifting end longitudinal axis extends into the door face substantially perpendicular to the latch arm and below it. When either lever's handle end is pulled away from its door face, the lever pivots about its angled pivot or fulcrum point raising its latch lifting end up such that the latch arm is contacted and lifted. In another embodiment the angled levers are substantially "L-shaped," having a handle leg and a latch lifting leg, and the pivot point occurs at the angle between the legs of the "L."

In another embodiment the latch device further includes a latch keep attached to the opposing door jamb, dimensioned and positioned to receive the keep end of the latch arm when the door is in the closed and latched position. The inside and outside levers are dimensioned such that when either lever handle is pulled, its latch lifting end is competent to lift the latch arm up and free of the latch keep, unlatching the door and allowing it to open.

In another embodiment, the inside and outside levers are positioned on their respective door faces such that they directly oppose each other. In this embodiment, the latching lifting ends of the levers terminate below the latch arm such that they are mutually opposing, with one latch lifting end positioned on top of, or superposed on, the other. In this embodiment, when the handle end of the "lower" lever is pulled, its rising latch lifting end also lifts the latch lifting end of the "upper" lever above it, which contacts and lifts the latch arm. When the "upper" lever handle end is pulled, the "lower" lever is not impacted. In one embodiment the inside lever can be positioned as the 'lower" lever, raising the outside lever's lifting end together with its own when its handle end is pulled. In another embodiment, the outside lever can be positioned as the "lower" lever.

In another embodiment, the inside and outside levers can be positioned on their respective door faces such that the levers are offset laterally and each lever's latch lifting end contacts the latch arm directly when its handle end is pulled.

In another embodiment, the latch arm is positioned on the surface of the inside door face. In this embodiment, the latch lifting leg of the outside lever has a length sufficient to pass through the door body and terminate below the latch arm. Preferably, the outside latch lifting leg passes through a substantially hollow channel in the door body dimensioned to both receive the latch lifting leg and allow it to rise sufficiently to lift the latch arm.

In another embodiment, the latch arm could be placed within the door body itself, in an opening dimensioned to allow vertical movement of the arm. In this embodiment both the inside and outside lever latch lifting ends extend into the door body, preferably through a channel.

In still another embodiment, the lever attachment means comprises a rigid component, an extension or projection extending out from the door face surface and attached to the lever's pivot point. In one embodiment the component is a bar extending out perpendicularly from an escutcheon plate attached to the door surface and parallel to the lever latch lifting leg. In still another embodiment the attachment means attaches to the lever angled pivot point by means of a bolt or pin. In still another embodiment the attachment means comprises a hollow sleeve that the latch lifting leg passes through.

In another embodiment, the lever handle end can be partially surrounded by a rigid housing comprising a recess into which the handle end can move when the handle end is pulled. The housing can be decorative and can provide a backstop limiting the degree to which the handle end can be pulled, preventing unnecessary wear or over-extension of the lever.

In another embodiment, the latch device disclosed herein can include a lock. In one embodiment, the lock can comprise means for retaining the latch arm in its latch keep and preventing it from being lifted when either lever handle end is pulled. In another embodiment, the lock can comprises a pivotable block located on the inside door surface above the latch arm. In another embodiment, the block has a contact surface that touches the latch arm and prevents its upward movement when the lock is in the locked position. In still another embodiment the contact surface can be pivoted out of position, allowing the latch arm to lift, when the lock is in the unlocked position. In still another embodiment, the lock can be positioned above the latch keep end of the latch arm. It will be appreciated by those having ordinary skill in the art that the block can be of any shape.

DESCRIPTION OF THE DRAWINGS

The foregoing aspects and many of the attendant advantages of this disclosure will become more readily appreciated as the same become better understood by reference to the following detailed description, when taken in conjunction with the accompanying drawings, where like-numbered parts reference like-membered components and wherein.

DETAILED DESCRIPTION

Embodiments of the present disclosure provide locksets, latch devices, components, and methods of use of these. In particular, embodiments of the present disclosure provide a two-way latch device for use on a door or other movable barrier to an opening or portal in an otherwise fixed wall or barrier. In one preferred embodiment, the moveable barrier is a hinged door that provides an opening between rooms or in and out of a building. It will be appreciated by those having ordinary skill in the art that the latch device disclosed herein also may be used to advantage on a gate or other similar structure, and where the fixed wall is a fence or other barrier.

TERMS AND DEFINITIONS

As used herein "lockset" is understood to mean the components that make up a locking or latching mechanism that can usually be found on a door. "Lockset" and "latch device" are used interchangeably herein. "Door" is understood to mean any moveable barrier to an opening or portal in a wall or other fixed barrier, particularly a moveable barrier that can be attached to the fixed barrier by a hinge or sliding mechanism, and can also be latched to the fixed barrier or wall. Examples of useful moveable barriers include doors, gates, hatches, window covers and the like. A "latch," also referred to in the literature and herein as a "latch bar," "latch arm" or "drop bar" is understood to mean a bar or similarly shaped device located in or on a door or gate that can fall or slide into a groove, catch or hole on or in a door jamb or gate jamb to keep the door or gate closed. When the latch bar is located on a door or gate surface, the groove that catches the latch bar is referred to in the literature and herein as the latch "keep" or "catch."

Figure 1:
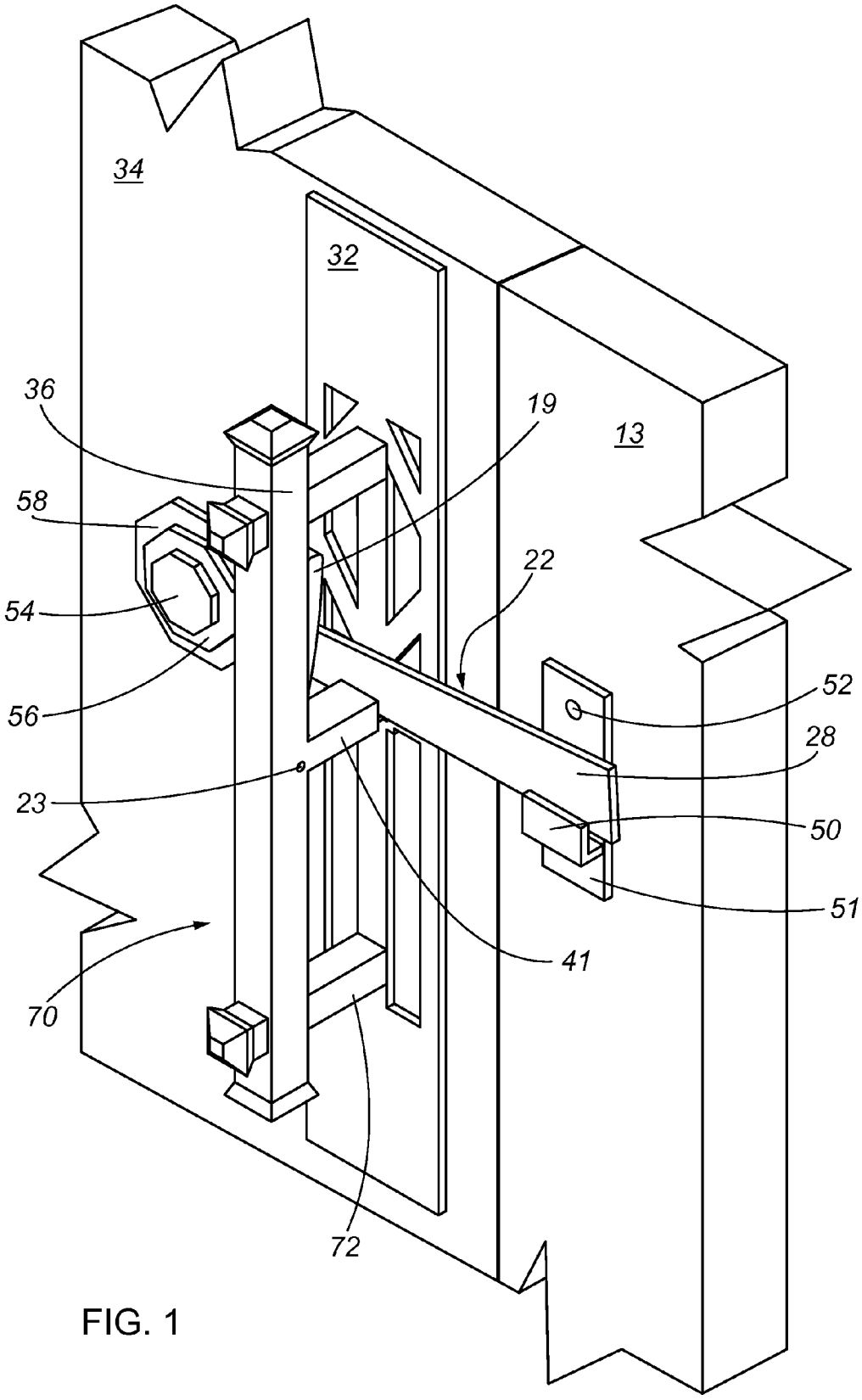
FIG. 1 is a perspective view of one embodiment of a latch device in the closed position according to the present disclosure.
Figure 2:
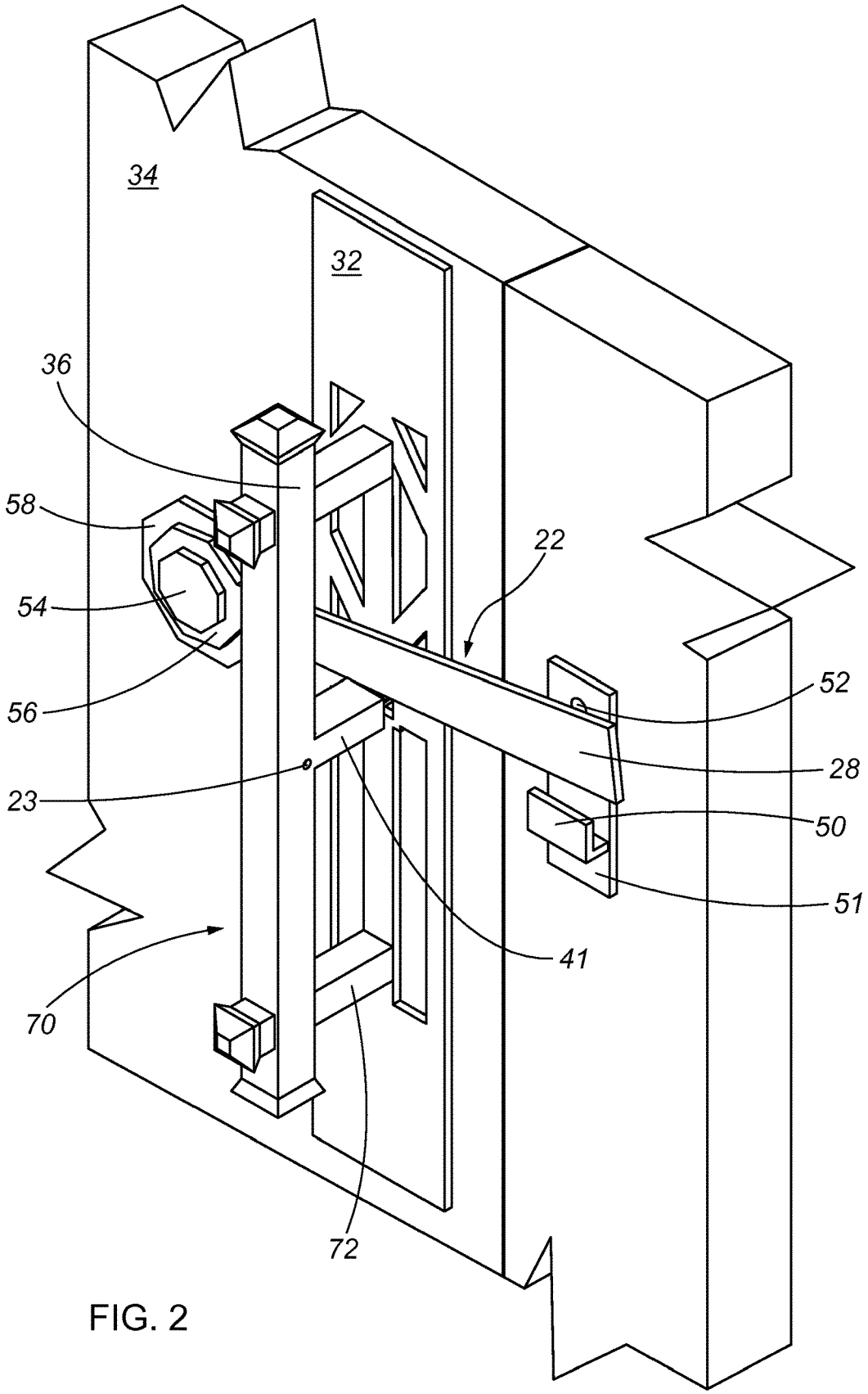
FIG. 2 is a perspective view of one embodiment of a latch device in the open position according to the present disclosure.

Referring now to FIGS. 1 and 2, one embodiment of a latch device of the present disclosure on an inside door face is depicted, with FIG. 1 showing the latch device in the closed position and FIG. 2 showing the latch device in the open position. In the figures latch arm 22 is positioned on the surface of door 34's inside face. Latch arm 22 can comprise a bolt end 56, for attaching latch arm 22 to door 34, for example by means of bolt 54 and bolt plate 58. Latch arm 22 also can comprise a latch keep end 28, which can rest on a latch keep 50. Typically, latch keep 50 is attached to a door jamb 13, for example by means of a bolt 52 through latch keep plate 51. Door 34 further can include a handle 70 for moving the door into an open or closed position, as by pulling or pushing. Handle 70 can be attached to door 34 by means of an escutcheon or rosette 32. Escutcheon 32 illustrated in the figure is exemplary only, and escutcheons and rosettes having other shapes, decorative elements and attachment means to handle 70 are contemplated. The handle 70 illustrated in the figures includes one or more projections or spacers 72 for placing handle 70 at a desired distance from the door. Handle 70 and its spacers 72 can be attached to door 34 or escutcheon 32 by any standard attachment means, including bolting.

In the closed position, the latch keep end 28 of latch arm 22 rests in latch keep 50, preventing door 34 from being pulled open by handle 70. In the open position, latch arm 22 is pivoted up about latch bolt 54 and latch keep end 28 is free of latch keep 50, allowing door 34 to be pulled or pushed opened, for example by manipulating handle 70.

Generally, latch arm 22 can be positioned on the inside of a door, also known as the side of the door where control over latch movement and door opening is desired—into a room from a hall, for example, or into a building from outside. In addition, latch arm 22 typically can be positioned on the outer surface of the inside face of door 34. If desired however, alterations to these general applications can be made without undue experimentation, including placing latch arm 22 inside the body of door 34, in a channel or cavity made therein, rather than on the door face.

Figure 3:
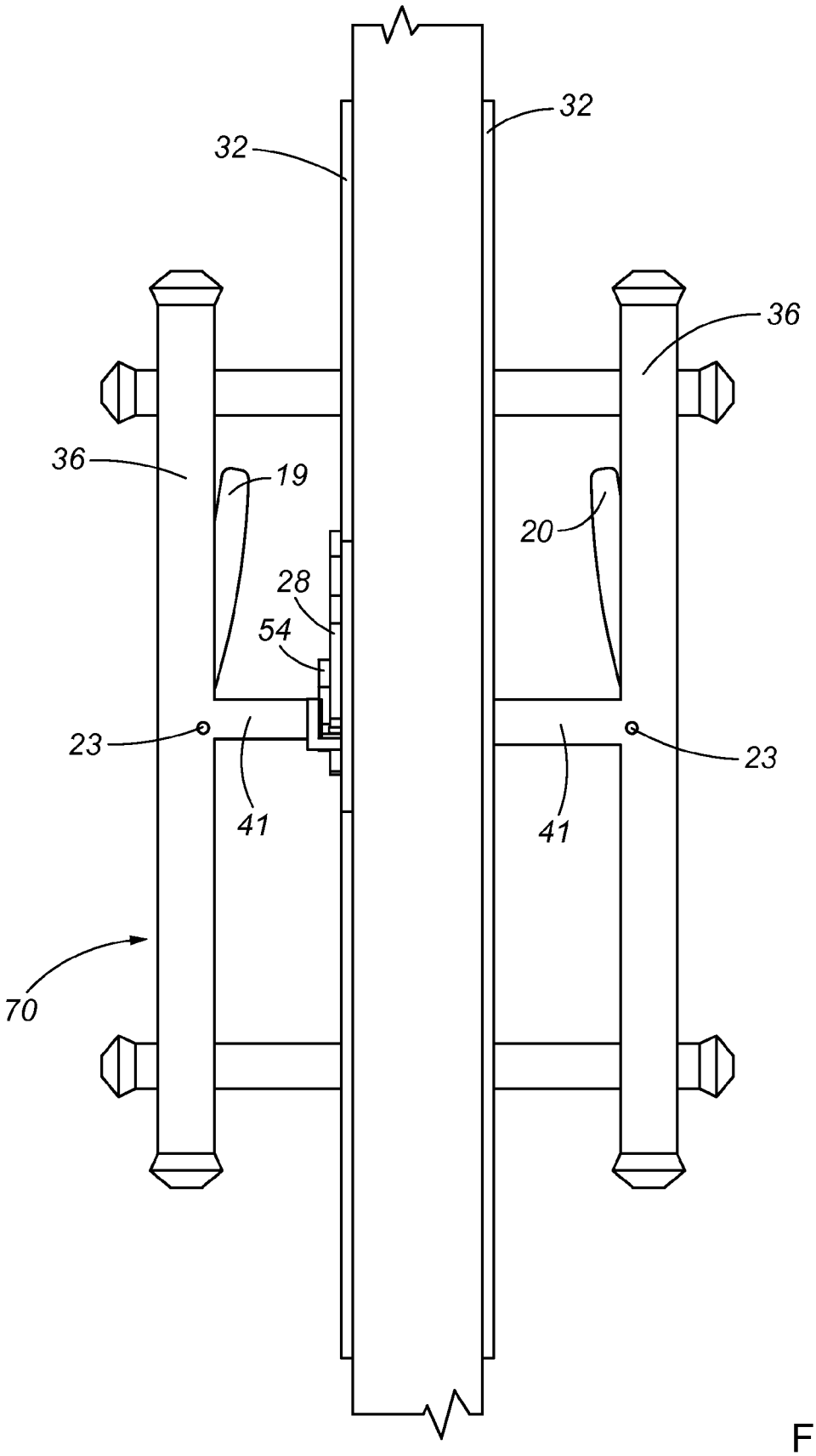
FIG. 3 is a side view of an embodiment of a latch device according to one embodiment of the present disclosure.

FIG. 3 is a side view of the latch device embodiment illustrated in FIGS. 1 and 2, illustrating one embodiment of a latch device of the present disclosure and its associated door handles 70. Together with FIGS. 4-6, which show latch device 10 in cross-section, the figures illustrate an embodiment where handles 70 are diametrically opposed to one another as are inside latch lever 12 and outside latch lever 14, both components of latch device 10. Each latch lever 12 and 14 can comprise an angle, which provides a pivot point 23 and two legs. One leg can comprise the handle end of the lever, illustrated as handle end 19 for inside lever 12, and handle end 20 for outside lever 14. The second leg can comprise the latch lifting leg of the lever, illustrated as leg 26 for inside lever 12 and leg 24 for outside lever 14. As illustrated, levers 12 and 14 can be substantially "L-shaped." In the device, levers 12 and 14 can be positioned with pivot point 23 located on handle 70 such that the lever handle leg extends vertically and parallel both to handle 70 and the vertical plane of door 34, and the latch lifting leg extends into the surface of door 34 through opening 44, perpendicular to handle 70 and the vertical plane of door 34. If desired, the latch lifting legs can extend into the door surface through an opening in escutcheon 32, which opening can provide both a rest for the lever leg and a means for protecting the door surface from wear.

In the figures, levers 12 and 14 are diametrically opposed to one another, with outside latch lifting leg 24 passing through a channel 42 in door 34, its end or tip 25 opposing and resting on top of inside latch lifting leg end 27. It will appreciated by those having ordinary skill in the art that, if desired, levers 12 and 14 can be configured such that inside latch lifting leg end 27 rests on outside lever leg end 25 such that the leg ends are mutually opposing and overlap, with one leg end superposed on the other. It also will be appreciated that handles 70 and levers 12 and 14 can be offset on door 34 such that latch lifting leg ends 25 and 27 lie adjacent one another and not on top of one another. It also will be appreciated that channel 42 can be substantially hollow and dimensioned to provide an opening through door 34 for lever leg 24, channel 42 having an interior height and width sufficient to allow lever leg 24 to lift latch arm 22 clear of the latch keep when lever 14 is pivoted about pivot point 23. As also will be appreciated by those skilled in the art, latch lifting ends 25 and 27 of legs 24 and 26, respectively, can be the same thickness as the legs or, as illustrated in the figures, tips 25 and 27 can be thinner. Thinner latch lifting ends can reduce lever weight for ease of manipulation, for example, provided sufficient stability is provided to lift latch arm 22.

Extensions 41 can provide means for attaching levers 12 and 14 to door 34 at lever pivot points 23. It will be appreciated that any useful attachment means is contemplated that allows pivoting, such as for example, by bolting at pivot point 23. In the figures, extensions 41 comprise sleeves defining substantially hollow channels 40 extending from escutcheon 32 and surrounding door surface openings 44. Lever legs 24 and 26 pass through channels 40, and at least a portion of legs 24 and 26 can rest on, and be supported by, the bottom interior surface of channels 40. It will be appreciated by those having ordinary skill in the art that extensions 41 can be any rigid component to which levers 12 and 14 can be attached at pivot point 23. Where extension 41 is a bar, it advantageously can be placed next to or adjacent the lever leg. It also can be positioned underneath the lever leg, thereby providing additional support for the leg. Where extension means 41 provides a support means for the latch lifting lever leg, it also can provide means for supporting the latch arm resting on the lever leg, particularly when the door is in the closed, latched position, and the levers are in their resting positions (see below). Where extension 41 is a sleeve, as illustrated, or a bar adjacent or adjoining the lever leg, the inside extension 41 upper surface can be contoured or truncated to accommodate latch arm 22 in the latched position.

The method of action of latch device 10 allows latch arm 22 to be lifted by pulling on either lever handle end 19 or 20. Pulling on the desired lever handle end pivots that lever about pivot point 23, which raises the latch lifting leg of the lever, thereby contacting latch arm 22 and lifting its latch keep end up and out of the latch keep. This allows door 34 to be opened, for example by pulling or pushing on the door itself or a handle 70. When the lever is released, the latch arm is released to its horizontal resting position on the lever latch lifting ends. If door 34 has been pulled away from door jamb 32, latch keep end 28 of latch arm 22 is free. If door 24 is opposing door jamb 32 when the lever is released, latch keep end 28 of latch arm 22 rests in latch keep 50. In the figures, inside extension sleeve 41 is contoured to allow latch arm 22 to pass through its upper surface and rest on the lever ends.

Figure 4:
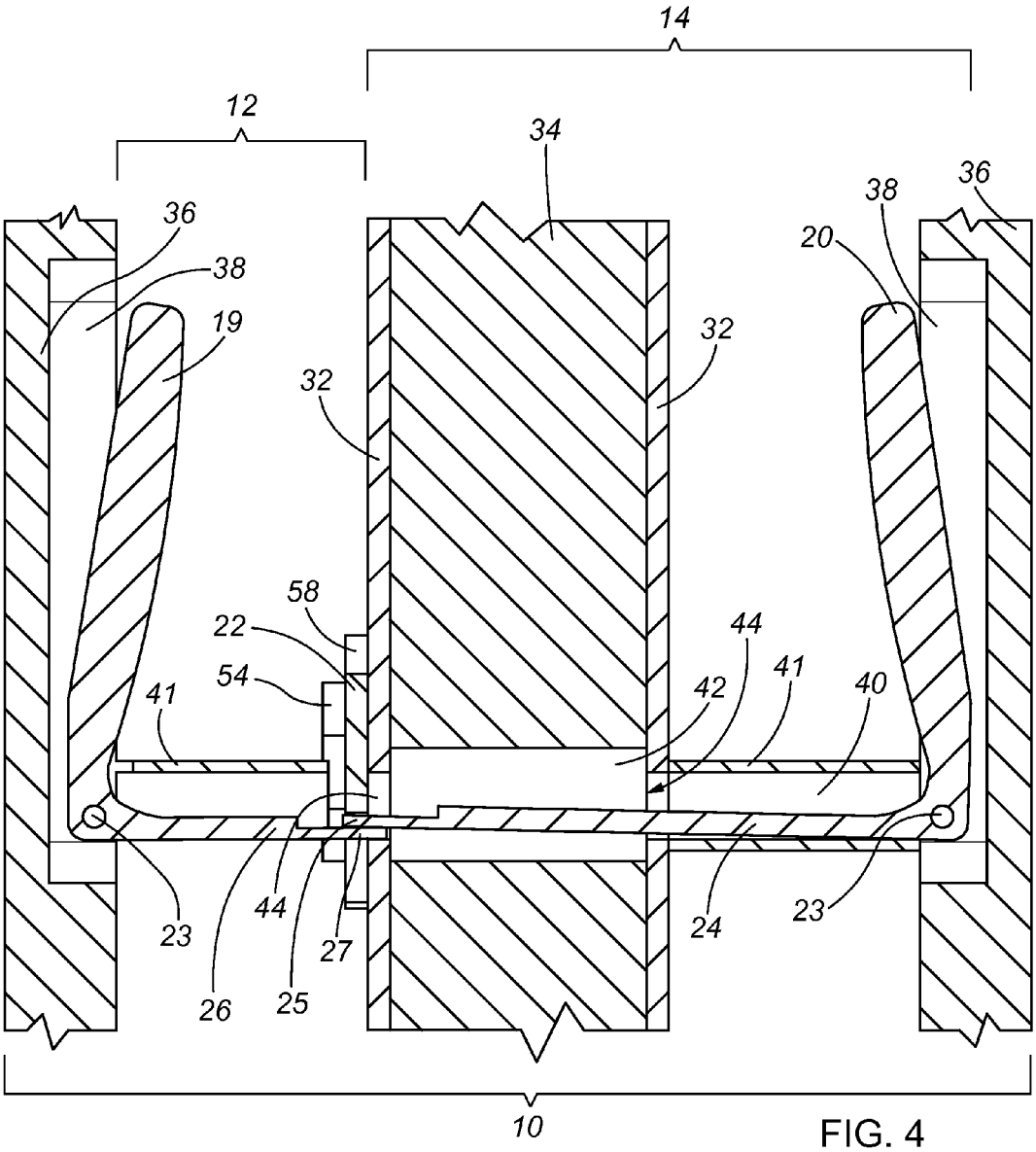
FIG. 4 is a cross-section of one embodiment of a latching mechanism in the closed position according to the present disclosure.
Figure 5:
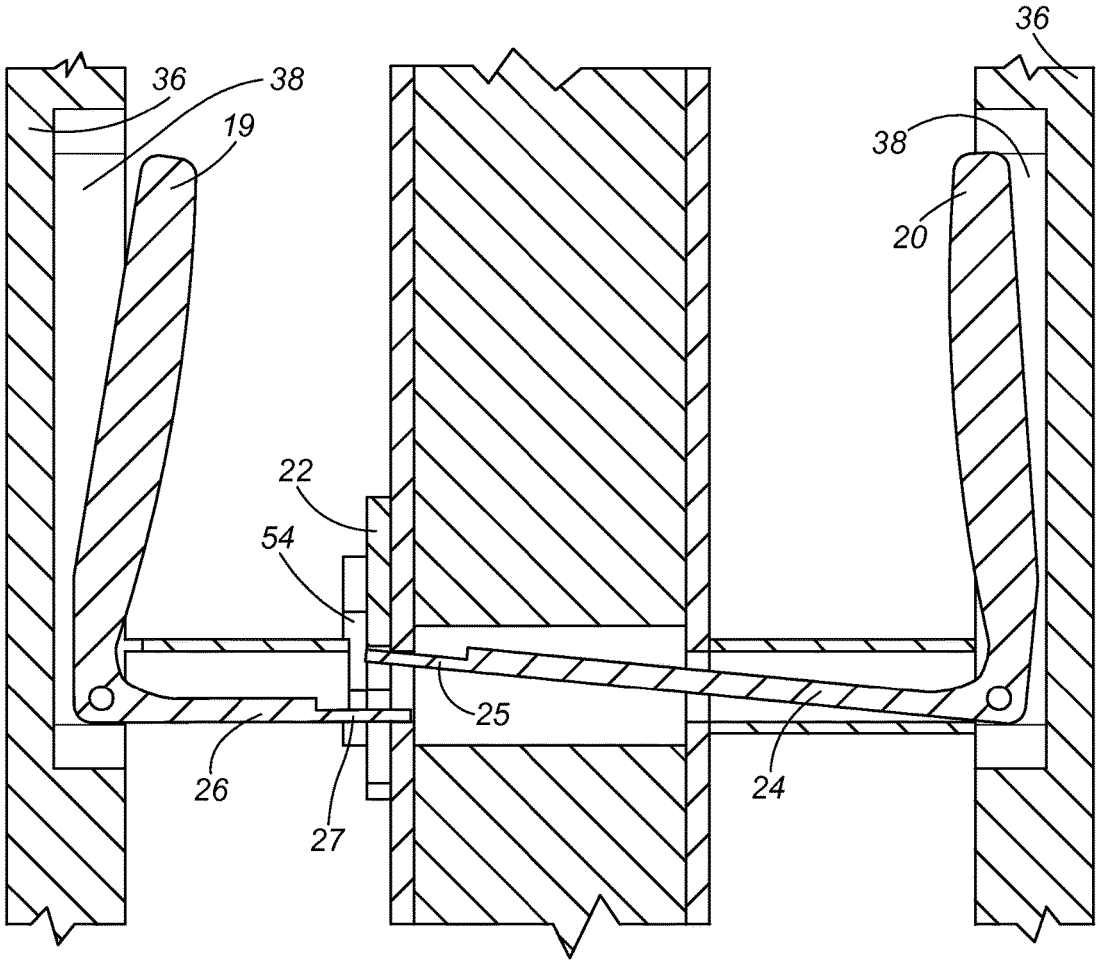
FIG. 5 is a cross-section of one embodiment of a latching mechanism opened from the outside according to the present disclosure.
Figure 6:
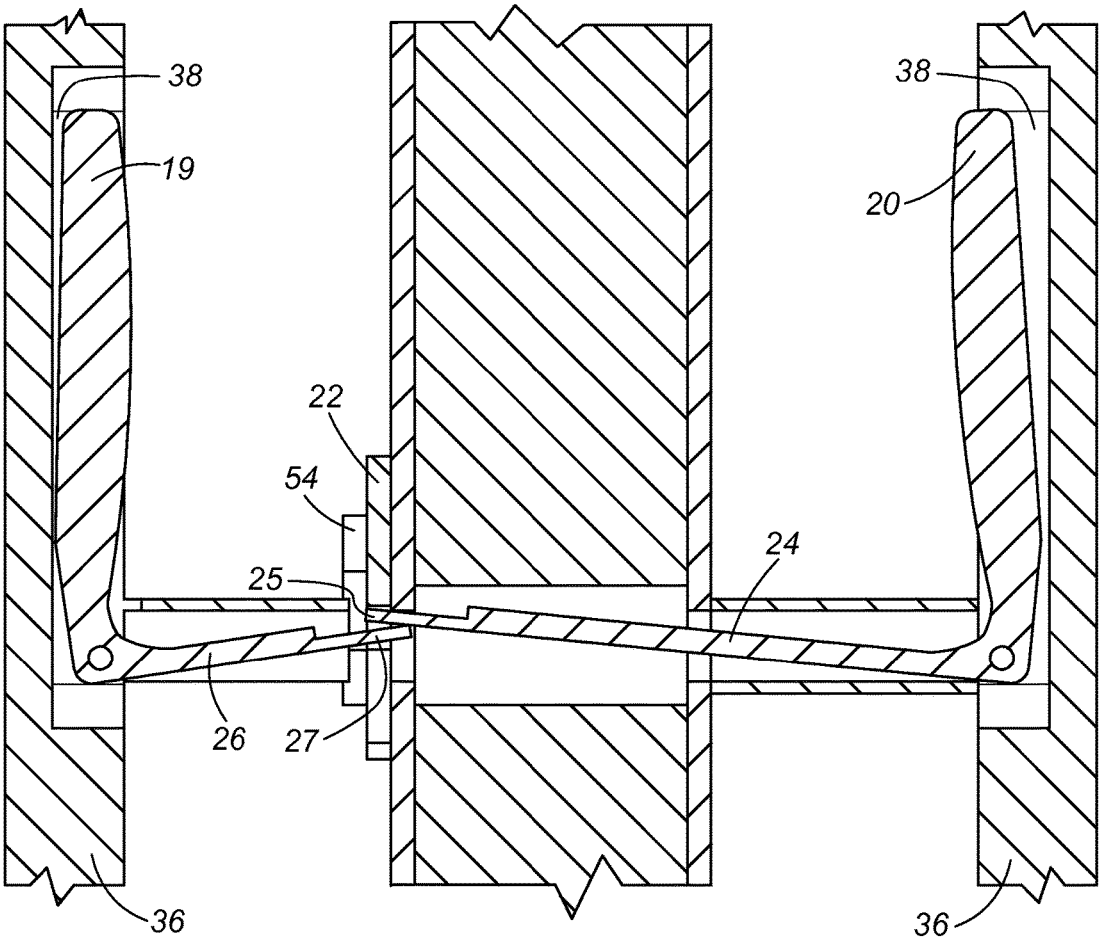
FIG. 6 is a cross-section of one embodiment of a latching mechanism opened from the inside according to the present disclosure.

As will be appreciated by those skilled in the art, it can be advantageous, though not required, to provide a backstop for lever handle ends 19 and 20. An exemplary backstop 36 is depicted in FIGS. 4-6, wherein the backstop makes up part of handle 70. Backstop 36 includes a recess 38 into which the lever handle end moves when it is pulled. Backstop 36 can provide means for limiting wear on pivot attachment point 23 or other components of latch device 10 by limiting the distance the lever legs travel during operation. In the latch device illustrated herein, the lever angle is less than 90°, and the handle leg is pitched forward somewhat from vertical when the lever is in the resting position. When gripped and maneuvered against the backstop the lever handle leg moves into a substantially perpendicular position. It will be appreciated by those skilled in the art that the lever shape can vary, as can the lever angle, without undue experimentation. For example, the lever angle could be 90°, and a backstop and recess fabricated to accommodate it, and/or the lever leg could be curved with similar accommodation built into recess 38, and/or backstop 36.

FIG. 4 shows latch device 10 in the closed and resting position. In FIG. 5, outside lever handle end 20 has been pulled into outside backstop recess 38, pivoting outside lever 14 about its lever pivot point 23, raising outside lever latch lifting leg 24 such that latch lifting end 25 lifts latch arm 22. In FIG. 6 inside lever handle end 19 has been pulled into inside backstop recess 38, pivoting inside lever 12 about its lever pivot point 23, raising inside lever latch lifting leg 26 such that latch lifting end 27 lifts both outside latching lifting end 25 and latch arm 22.

Figure 7:
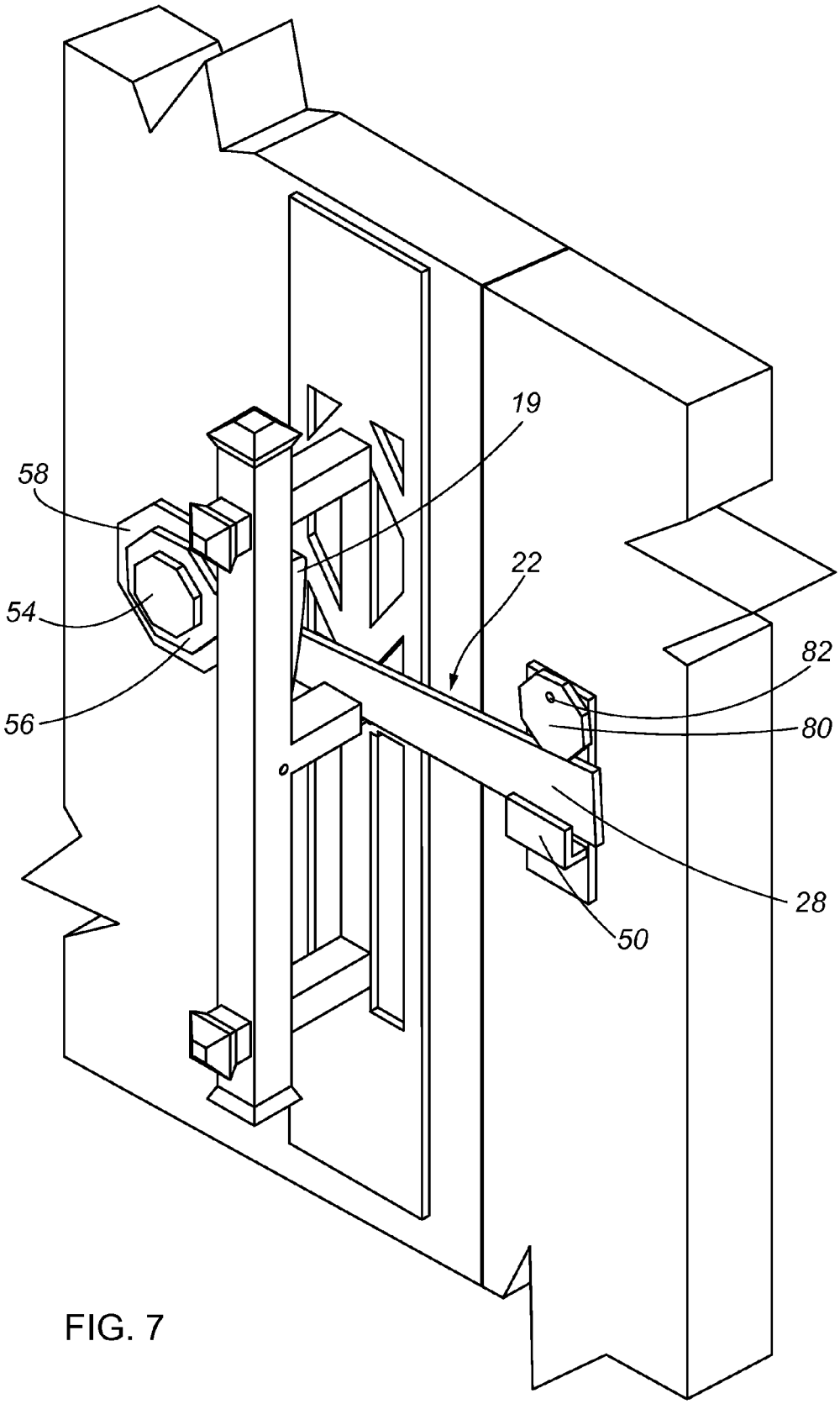
FIG. 7 is a perspective view of one embodiment of a latch device and lock according to the present disclosure, in a closed and locked position.
Figure 8:
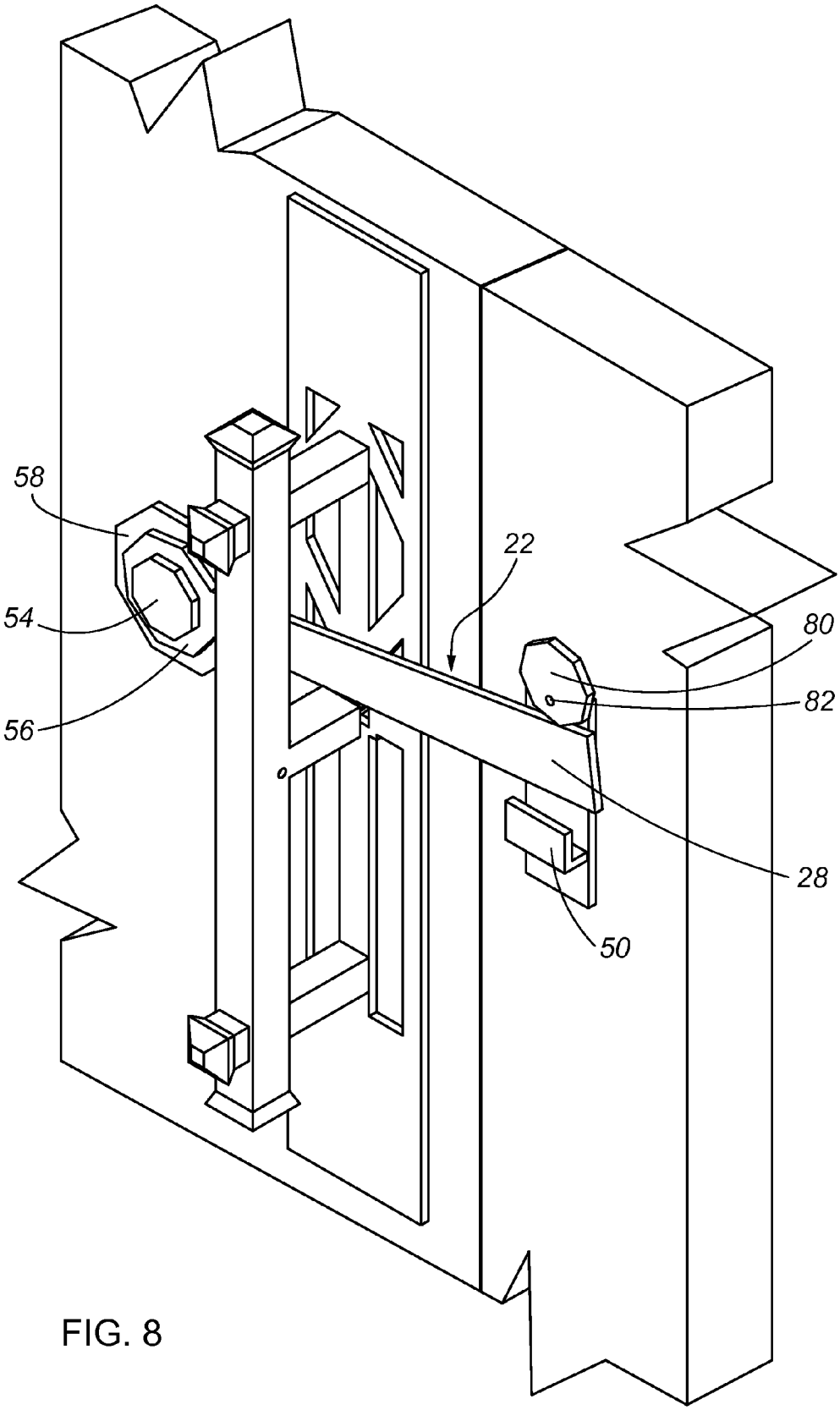
FIG. 8 is a perspective view of one embodiment of a latch device and lock according to the present disclosure, in an open position.

FIGS. 7 and 8 illustrate an embodiment that includes means for locking latch device 10 in the closed and latched position. Illustrated in the figures is a rigid, pivotable block 80 dimensioned and positioned above latch arm 22 such that it can contact and prevent upward movement of latch arm 22 when either handle is pulled. Lock 80 can include a pivot point 82 opposite the latch arm contact point, and pivot point 82 also can provide means for attaching lock 80 to door jamb 13. Rotating lock 80 about pivot point 82 moves the lock up and away from latch keep end 28, allowing the door to be opened when a handle is pulled. The pivot mechanism can be loose, in which case lock 80 will naturally return to the down and locked position by force of gravity unless it is manually or physically held up; or the pivot mechanism can be tight, so that lock 80 remains in the up and unlocked position unless manually pivoted back into the down and locked position. In the figures, lock 80 is near latch arm end 28 on door jamb 13. In particular, in the example illustrated, lock 80 occurs on keep plate 51 and lock attachment means/pivot point 82 is also keep plate bolt 52. It will be appreciated by those skilled in the art that lock 80 also can be located at other positions along latch arm 22, including positions on door 34.

Latch device 10 and its related components, including handle 70 and lock 80, can be made of any useful durable and sufficiently rigid materials, including metal, plastic, stone and/or wood. Choices of materials and component dimensions selected will depend on the size and thickness of door chosen, dimensions of desired latch device and handle, and aesthetic and decorative choices made, including handle shape, latch arm shape, and the like. For example, the exemplary latch device and door illustrated in the figures could be considered to be of a medieval revival or rustic style, with strong angles, studs and finials, and decorative cuts in the escutcheon. Other evocative styles can be selected including, for example, roman, victorian, oriental, or modern, any of which would vary the decorative components of the device and handle, including the choice of escutcheon or rosette. Similarly, lock 80, latch arm bolt 54, latch arm bolt end 56 and latch arm bolt plate 58, all have a particular shape, in this case an octagon. It will be understood by those skilled in the art that these components could have a range of shapes and do not all have to have the same shape in a single latch device.

Embodiments of this disclosure may be embodied in other specific forms without departing from the spirit or essential characteristics thereof. The present embodiments are therefore to be considered in all respects as illustrative and not restrictive, the scope of the disclosure being indicated by the appended claims rather than by the foregoing description, and all changes that come within the meaning and range of equivalency of the claims are therefore intended to be embraced therein. While illustrative embodiments have been illustrated and described, it will be appreciated that various changes can be made therein without departing from the spirit and scope of the disclosure.

The embodiments of the invention in which an exclusive property or privilege is claimed are defined as follows:

1. A two-way latch device for a door having an inside and an outside face, the device comprising:

a) a latch arm having a pivot end and a latch keep end, secured to the inside face of said door at said pivot end and positioned substantially perpendicular to the vertical axis of the door;

b) a pair of opposing handles comprising a vertically extending hand grip end and, joined substantially perpendicular thereto, an extension for connecting said handle to one face of said door, each hand grip end defining a recess, each extension defining a channel having an axial opening at said door connection end and means for attaching to said door such that said axial opening matches a channel extending through said door below said latch arm, said extension connecting to said inside door face further defining a latch keep having an opening for receiving said latch arm;

c) a pair of opposing levers having a single angled pivot point, a handle end and a latch lifting end, and means for attaching said lever pivot point to one of said handles at said extension joint such that said lever handle end aligns with said handle recess and said latch lifting end fits in said extension channel, the latch lifting end of said lever in said extension connecting to said outside door face dimensioned to extend through said door channel and into said inside door face extension channel such that one latching lifting end rests on top of the other, opposing latch lifting end and said latch arm engages the top latch lifting end in said channel latch keep, whereby when either said lever handle end is pulled away from said door face into said handle recess, said lever pivots about its angled pivot point raising said latch lifting end such that said latch arm is lifted out of said extension channel latch keep and opens said door.

2. The latch device of claim 1 wherein said top latch lifting end corresponds to the inside door face lever.

3. The latch device of claim 1 wherein said top latch lifting end corresponds to the outside door face lever.

4. The latch device of claim 1 wherein said extension connects to said door and said door channel via an escutcheon attached to said door face.

5. The latch device of claim 1 further comprising a locking mechanism, the locking mechanism comprising:

a) a second latch keep attached to an opposing door jamb of said inside door face, positioned to receive the distal end of said latch arm when said latch arm is also received in the first latch keep, and b) a pivotable block substantially flush with said door jamb and removably coupled to said door jamb at a pivot point above said latch arm in said second latch keep such that when said block is rotated about said pivot point into a locked position said block prevents said latch arm from moving up and out of said second latch keep when either said lever handle end is pulled away from said door face into said handle recess.

6. A method of latching a door having an inside and an outside face comprising the steps of:

a) providing a door having an inside and an outside face;

b) providing (i) a latch arm with a pivot end and a latch keep end on said inside face, said latch arm secured to said inside face at said pivot end and positioned substantially perpendicular to the vertical axis of said door;

(ii) a pair of opposing handles comprising a vertically extending hand grip end and, joined substantially perpendicular thereto, an extension for connecting said handle to one face of said door, each hand grip end defining a recess, each extension defining a channel having an axial opening at said door connection end and means for attaching to said door such that said axial opening matches a channel extending through said door below said latch arm, said extension connecting to said inside door face further defining a latch keep having an opening for receiving said latch arm;

(iii) a pair of opposing levers having a single angled pivot point, a handle end and a latch lifting end, and means for attaching said lever pivot point to one of said handles at said extension joint such that said lever handle end aligns with said handle recess and said latch lifting end fits in said extension channel, the latch lifting end of said lever in said extension connecting to said outside door face dimensioned to extend through said door channel and into said inside door face extension channel such that one latching lifting end rests on top of the other, opposing latch lifting end, and c) placing said latch arm in said channel latch keep such that said latch arm engages the top latch lifting end in said channel latch keep when said door is closed and, when either said lever handle end is pulled away from said door face into said handle recess, said lever pivots about its angled pivot point raising said latch lifting end such that said latch arm is lifted out of said extension channel latch keep and opens said door.

7. A method of locking a door having a two-way latch mechanism, the method comprising:

a) providing a door having an inside and an outside face and comprising:

(i) a latch arm having a pivot end and a latch keep end, secured to the inside face of said door at said pivot end and positioned substantially perpendicular to the vertical axis of the door;

(ii) a pair of opposing handles comprising a vertically extending hand grip end and, joined substantially perpendicular thereto, an extension for connecting said handle to one face of said door, each hand grip end defining a recess, each extension defining a channel having an axial opening at said door connection end and means for attaching to said door such that said axial opening matches a channel extending through said door below said latch arm, said extension connecting to said inside door face further defining a latch keep having an opening for receiving said latch arm;

(iii) a pair of opposing levers having a single angled pivot point, a handle end and a latch lifting end, and means for attaching said lever pivot point to one of said handles at said extension joint such that said lever handle end aligns with said handle recess and said latch lifting end fits in said extension channel, the latch lifting end of said lever in said extension connecting to said outside door face dimensioned to extend through said door channel and into said inside door face extension channel such that one latching lifting end rests on top of the other, opposing latch lifting end and said latch arm engages the top latch lifting end in said channel latch keep;

b) providing (i) a second latch keep to an opposing door jamb of said inside door face, positioned to receive the distal end of said latch arm when said latch arm is also received in the first latch keep, and (ii) a pivotable block substantially flush with said door jamb and removably coupled to said door jamb at a pivot point above said latch arm in said second latch keep such that when said block is rotated about said pivot point into a locked position said block prevents said latch arm from moving up and out of said second latch keep when either said lever handle end is pulled away from said door face into said handle recess;

c) placing said latch arm in said channel latch keep and said second keep, and d) rotating said block into said locked position.

* * * * *